US005857373A

United States Patent [19]

De Mare et al.

[11] Patent Number: 5,857,373

[45] Date of Patent: Jan. 12, 1999

[54] METHOD AND DEVICE FOR MANUFACTURING COLD ROLLED METAL SHEETS OR STRIPS

[75] Inventors: Carl De Mare, Belsele; Yves Gadeyne, Assenede, both of Belgium

[73] Assignee: Sidmar N.V., Gent, Belgium

[21] Appl. No.: 716,338

[22] PCT Filed: Mar. 29, 1995

[86] PCT No.: PCT/EP95/01183

§ 371 Date: Sep. 30, 1996

§ 102(e) Date: Sep. 30, 1996

[87] PCT Pub. No.: WO95/26836

PCT Pub. Date: Oct. 12, 1995

[30] Foreign Application Priority Data

Mar. 30, 1994 [EP] European Pat. Off. ..... 94870057

[51] Int. Cl.[6] ..... B21B 39/20

[52] U.S. Cl. ..... 62/252.5; 72/366.2; 29/895.3

[58] Field of Search ..... 72/199, 252.5, 72/365.2, 366.2; 29/527.4, 895.3; 428/687, 923, 600

[56] References Cited

U.S. PATENT DOCUMENTS

| | | | |
|---|---|---|---|
| 4,866,830 | 9/1989 | Zohler | 72/98 |
| 4,996,113 | 2/1991 | Hector et al. | 72/199 |
| 5,025,547 | 6/1991 | Sheu . | |
| 5,508,119 | 4/1996 | Sheu et al. | 72/199 |
| 5,537,851 | 7/1996 | Sheu et al. | 72/366.2 |
| 5,608,969 | 3/1997 | Fields et al. | 29/895.3 |

FOREIGN PATENT DOCUMENTS

| | | | |
|---|---|---|---|
| 2-41702 | 2/1990 | Japan | 72/366.2 |
| 6-63603 | 3/1994 | Japan | 72/366.2 |
| 1733159 | 5/1992 | U.S.S.R. | 72/366.2 |
| 9205890 | 4/1992 | WIPO . | |
| 9205891 | 4/1992 | WIPO . | |

OTHER PUBLICATIONS

Revue De Metallurgie, vol. 89, No. 12, 1992, Paris FR pp. 1083–1091.

Hamilius "Gravures des cylindres de laminage a l'aide d'un faisceau d'electrons" see whole document.

*Primary Examiner*—Joseph J. Hail, III

*Assistant Examiner*—Ed Tolan

*Attorney, Agent, or Firm*—Merchant, Gould, Smith, Edell, Welter & Schmidt, P.A.

[57] ABSTRACT

Method of producing metal sheets or strips by rolling a metal sheet or strip through cold rolling mills, characterized in that at least two work rolls (2) are textured according to a surface pattern consisting in a regular deterministic bidimensional patter in the form of unit cells of spots, said spot being obtained through an electron beam irradiation (12) and in that the wavelengths in the longitudinal direction [$\lambda_L$] of the rolls and in the transverse direction [$\lambda_L$] of the rolls are less than 1.5 mm.

10 Claims, 10 Drawing Sheets

LASER TEXTURE : unidirectional periodicity

EBT TEXTURE : bidimensional periodicity

METHOD AND DEVICE FOR MANUFACTURING COLD ROLLED METAL SHEETS OR STRIPS

OBJECT OF THE INVENTION

The present invention relates to a method and a device for manufacturing cold rolled metal sheets or strips, through a cold rolling tandem mill or temper mill, in order to avoid the moiré effect on the metal sheets or strips.

The present invention relates also to metal sheets or strips obtained through cold rolling tandem or temper mills by using the method and the device of the present invention.

STATE OF THE ART

The cold rolling process consists essentially in pulling off the strip coming from the hot rolling mill from the uncoiler through a tandem mill comprising usually several stands of 2, 4 or 6 high rolls and to coil it up again. The rolled strip coil is then heated up in a furnace, this process is known as annealing process. Afterwards, the annealed coil passes again through cold roll mill called skin pass or temper mill.

It is a common practice in cold rolling metal sheet to apply a certain roughness to the work rolls of the last stand of the tandem mill and/or of the temper mill.

The roughness is usually obtained by engraving the tandem or temper mill rolls through shot blasting or Electron Discharge Technology (EDT). The result of using such techniques is a stochastical roughness.

It is also known to use the laser technology for texturing rolls intended to cold rolling mills (see Fachberichte H üttenpraxis Metallweiterverarbeitung Vol. 23, No. 10, 1985, pp 968–972). This technique creates isolated craters with rims on the roll surface which are arranged in helicoidal pattern around the roll giving rise to periodic unidirectional phenomenon as far as the crater distances in the direction of the helix (roll circumference) are concerned.

The electron beam technology (EBT) can also be used in order to texture cold rolls for cold rolling tandem or temper mills. Advantageously, with this technique bidimensional periodic patterns (circumferential and axial) are produced, in which the unit cell is repeated as in a wall paper pattern.

It is common knowledge that when two periodic phenomena are superimposed, an interference is created having a different periodicity from the two composing phenomena, in the optical field, this is generally known as moiré. When dealing with tandem and temper mill roll textures in the cold rolling process of metal sheet, the moiré phenomenon occurs when more or less deterministic textures are applied to the rolls.

Shot blast technique does not give rise to moiré, as the resulting textures are stochastic by nature. Laser, and electron beam (EBT) texturing and even EDT (electron erosion technique) are however subject to this optical interference pattern (see Journal of Materials Processing & a Manufacturing Science, volume 2, number 1, July 1993, p. 63, "Focused Energy Beam Work Roll Surface Texturing Science and Technology", L. G. Hector and S. Sheu).

During the cold rolling process, more can be created in two ways, when deterministic textures are used:

Moiré originates during the facing (or levelling) operation or the tandem or temper mill stand, i.e. when the upper and lower work rolls of a stand turn under load, touching each other, without a metal strip in between. During this process, the textures of both rolls are imprinted on each other, causing an unwanted moiré pattern. Subsequently this moiré pattern is transferred to the rolled sheet or strip, yielding a useless surface texture.

Another source of moiré can occur when a strip is firstly rolled in the tandem mill and subsequently, after annealing, in the temper mill, both mills being equipped with periodic textured rolls. The Superposition of the temper mill pattern on the existing tandem mill pattern can cause moiré.

In "Gravures des cylindres de laminage á l'aide d'un. faisceau d'électrons" (A. Hamilus; ea, La Revue de Métallurgie—CIT Décembre 1992), there is mentioned that to avoid the moiré effect between two deterministic patterns, it is necessary to rotate one pattern to the other over some degrees. This solution is technically not possible: the EBT texturing system is designed in such a way that the craters are always placed on parallel lines in the circumferential direction of the roll. Pivoting the pattern over some degrees is accordingly not possible.

Aim of the present invention

The main aim of the present invention is to avoid the moiré effect on metal sheets or strips which are obtained by manufacturing through cold rolling tandem and/or temper mills.

Documents WO-A 92/05890 and WO-A 92/05891 describe methods for producing surface structure generated on a roll, said structure having recesses produced by an electron beam and consisting in depressions and crater walls surrounding them. The diameters and the depths of the recesses are defined within a predeterminable range as well as the distance between recesses in both the circumferential and longitudinal directions of the roller. However, none of these documents describe the "moiréproblem" which can occur on steel sheets performed with such rolls and none of these documents describe a solution to overcome such drawback. These documents only describe the way how to reach a random spatial distribution of the recesses or a quasi-stochastic or pseudo-stochastic distribution of the recesses.

Document "Stahl und Eisen", vol. 110, no. 3, pages 55–60, describes also the several methods which can be applied to texture a roll in order to have either deterministic pseudo-stochastic or even stochastic structure on such roll.

Here again, only the methods in order to get precise structure on the roll are described and it never described the specific problems obtained with steel sheets performed by using such rolls.

Main characteristics of the present invention

The present invention relates to a method of producing metal sheets or strips by rolling a metal sheet or strip through cold rolling mills, characterized in that at least two work rolls are textured according to a surface pattern consisting in a regular deterministic bidimensional pattern in the form of unit cells of spots, said spot being obtained through an electron beam irradiation and in that the wavelengths in the longitudinal direction $\gamma_L$ of the rolls and in the transverse direction $\gamma_Q$ of the rolls are less than 1.5 mm., wherein $\gamma_L$ and $\gamma_Q$ are defined as follows:

$$\lambda_L = \frac{dq_1 dq_2}{m|kdq_2 - dq_1|}$$

$$\lambda_Q = \frac{dl_1 dl_2}{m|ldl_2 - dl_1|}$$

wherein $dl_1 = \max\,[dl^A, dl^B]$ $dl_2$=min [$dl^A$, $dl^B$]

$dg_1$=max [$n^A dA^A$, $n^B dA^B$]

$dq_2$=min [$n^A dA^A$, $n^B dA^B$]

m=min [$n^A$, $n^B$]

k,l=an entire number so that the denominator of $\gamma_L$ and $\gamma_Q$ is minimal dl=the distance between two spots in the circumferential direction of the roll (which is the longitudinal direction of rolling for a sheet of strip)

dq=the distance between two spots in the axial direction of the roll between two circumferential lines of spots (which is transverse to the rolling direction)=n.dA dA=distance between two circumferences in the axial direction n=number of windings on the roll before the crater has the same circumferencial position on the roll, n is an integer or a real number A=being the first textured work roll B=being the second textured work roll Both textured work rolls could be a pair of work rolls in any stand of a tandem mill and/or of a temper mill.

The textured work rolls could be once the upper work roll and/or the lower work roll in a stand of a tandem mill and once the upper work roll and/or the lower work roll in a stand of a temper mill.

Preferably the metal sheet or strip which was textured on one side through the tandem mill should be textured on the same side by the textured work roll in the temper mill.

If the metal sheet or strip is not reversed between the tandem and the temper rolling phases, this means that the upper and/or lower work roll of the pair of work rolls in the temper mill should correspond to the textured upper and/or lower work roll of the pair of work rolls in the tandem mill.

If the metal sheet or strip is reversed between the tandem and the temper rolling phases, this means that the upper and/or lower work rolls of the pair of work rolls in the temper mill should correspond to the textured lower and/or upper work roll of the pair of work rolls in the tandem mill.

Preferably, both rolls in a pair of work rolls in the last stand of the tandem mill are textured according to the process described hereabove, and also both rolls in a pair of work rolls in a stand of the temper mill are textured as described hereabove, the upper and the lower rolls of the pair of work rolls of the tandem mill having the wavelengths in the longitudinal direction [$\gamma L$] and in the transverse direction [$\gamma_Q$] are less than 1.5 mm.

Preferably, the centered regular hexagon is chosen as unit cell, but any other pattern could be used for antimoiré purpose i.e. square or rhombic patterns.

The present invention relates also to a device for producing metal sheets or strips by cold rolling a metal sheet or strip, said device comprising at least two work rolls which are textured according to a surface pattern consisting in a regular deterministic bidimensional pattern in the form of unit cells of spots, said spots being obtained through an electron beam irradiation and in that wavelengths in the longitudinal direction [$\gamma_L$] of the roll and in the transverse direction [$\gamma$] of the roll are less than 1.5 mm.

Both the textured work rolls could be the work rolls in any stand of a tandem mill and/or of a temper mill.

Both textured work rolls could be, once the upper work roll and/or the lower work roll in a stand of a tandem mill and once the upper work roll and/or the lower work roll in a stand of a temper mill.

The present invention also relates to a metal sheet or strip having a surface pattern which consists in regular bidimensional deterministic pattern in the form of unit cells of spots, each spot having the form of a circular indentation surrounding a protuberance and wherein the wavelength is so small of so large that it is invisible to the eyes.

Preferably, this metal rolled sheet or strip is characterized by the fact that the wavelength in the longitudinal and transverse direction are less than 1.5 mm.

DETAILED DESCRIPTION OF THE PRESENT INVENTION

When two periodical phenomena are superimposed, moiré cannot be avoided. The solution exists in obtaining a moiré pattern with a wavelength so small or so large that it becomes invisible to the eye. This is only possible, and only then, when the produced pattern is deterministic, bidimensional and can be controlled within very narrow limits ($\mu$m). Only the EBT technique is till now able to meet those requirements.

Figure 1:
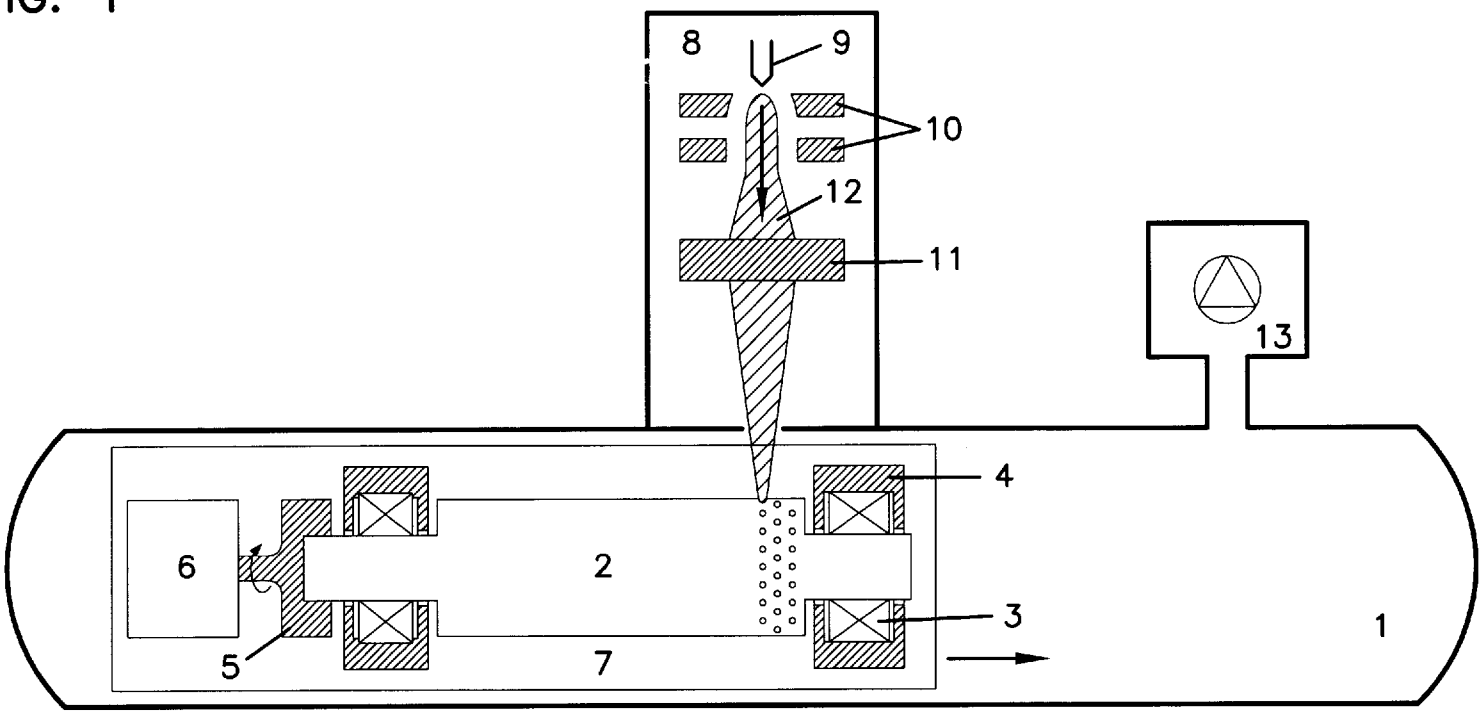
FIG. 1 is a schematic view of the EBT machine which is intended to texture cold rolls used in the method and the device of the present invention.

FIG. 1 describes an EBT machine which is intended to produce specific textures on cold rolls to be used in the method and the device of the present invention.

In general, one can compare the EBT machine to a highly energetic TV set, wherefrom the screen has been replaced by the roll surface to be textured. From this, the main advantages are:

flexibility reproducibility predictability productivity reliability full automation.

The EBT machine is essentially composed of the following parts:

the texturing chamber (1);

the electron gun (8);

the vacuum pump (13);

the closed circuit heat exchanger (not represented);

the electrical control cabinets (not represented).

The texturing chamber (1) consists of a cast metal base and aluminum cover, giving rise to an airtight unit. The cover has a movable lid on the top, in order to enable the loading and unloading of the rolls (2). During texturing the vacuum in the chamber (1) is kept constant at $10^{-1}$ mbar. The roll is rotated by means (3, 4, 5) of a continuously variable speed drive motor (6) at 600 to 1000 rpm, whereas a shifting mechanism (7) takes care of the translation of the roll (2) in front of the fixed position of the electron gun (8). From the moment a texture is chosen and the roll (2) is introduced into the texturing chamber (1), the machine set-up and the texturing process is performed automatically. The EBT machine is controlled by means of five microprocessors which are linked to each other and to the central control PC via a LAN (Local Area Networks) system, which is executed with fiber optics in order to avoid unwanted noise.

Figure 2:
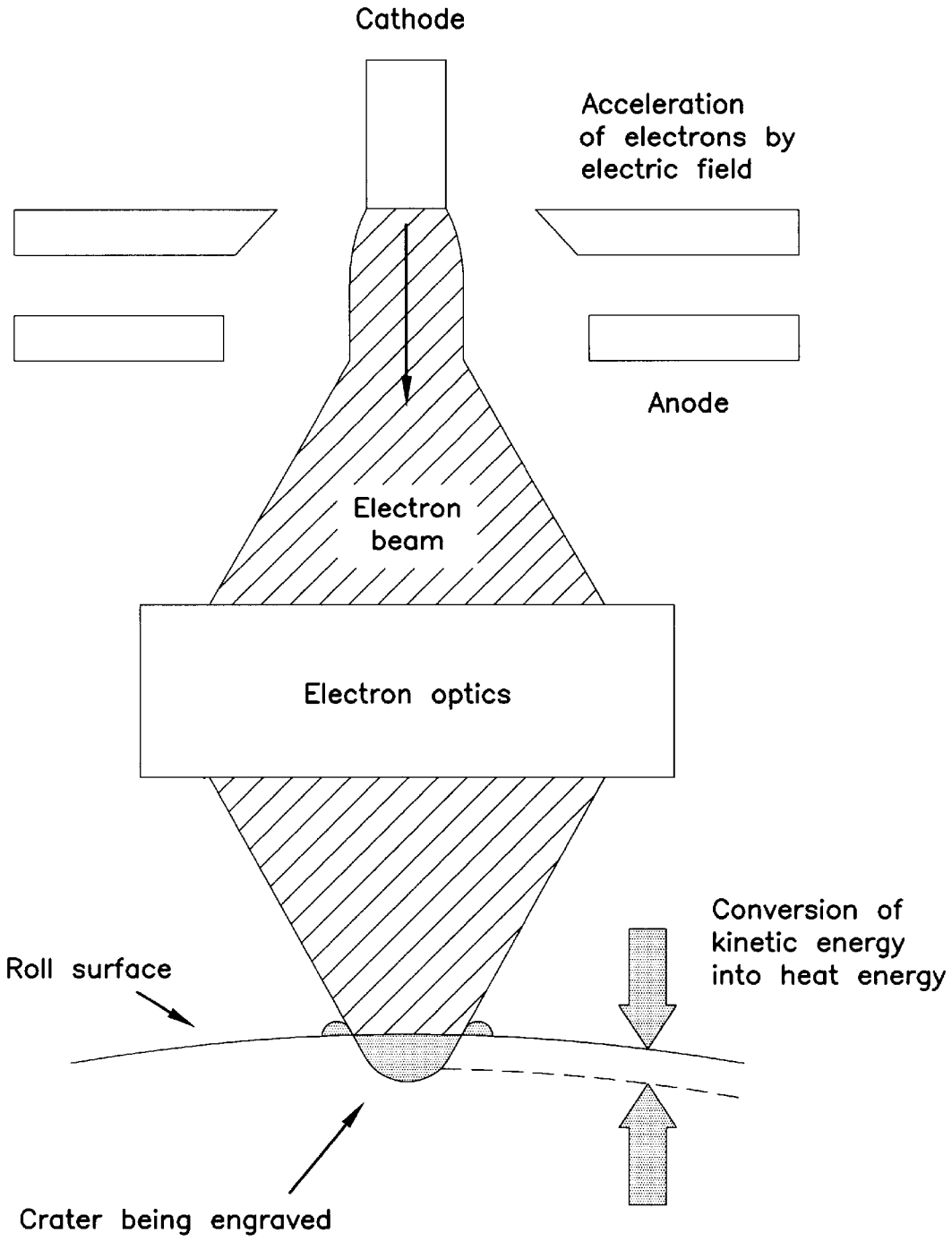
FIG. 2 is a schematic view of the electron beam gun of the machine of FIG. 1.

The principal part of the EBT machine is the electron gun (8) which is rigidly attached to the backside of the texturing chamber (1). As represented in FIG. 2, the electron beam gun (8) is composed of three parts:

the cathode (9)

the accelerator unit (10)

the zoom lens unit (11)

The electron gun can be described as a classical triode, equipped however with fast pulsing and zoom lens optics, which make it unique. The crater and rim forming process is schematically represented in FIG. 2. The gun operates under a vacuum of $10^{-3}$ to $10^{-4}$ mbar and uses an accelerating voltage of 35 kV at a maximum current of 75 mA. A direct heated cathode produces the electrons. The pulse frequency of the gun is continuously variable, with a maximum of 150 kHz. The shot cycles for the formation of a single crater, which can be performed in single or double shot, is represented as follows:

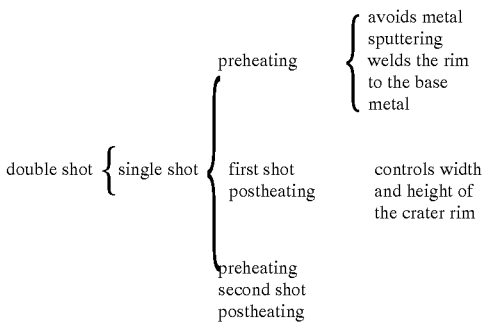

The total shot time per crater (first+second shot) is in the range of 2 to 15 $\mu$sec.

The electron beam is deflected in order to follow the translation and rotation of the roll during a crater formation. In this way, the whole roll surface is textured with perfectly circular craters. The shift speed is continuously variable from 0.03 to 0.36 m/min. The shift speed is controlled by the shift and rotation speed-of the roll, monitored by decoders, which in turn control the timing of the impact of the electron beam.

Figure 3A:
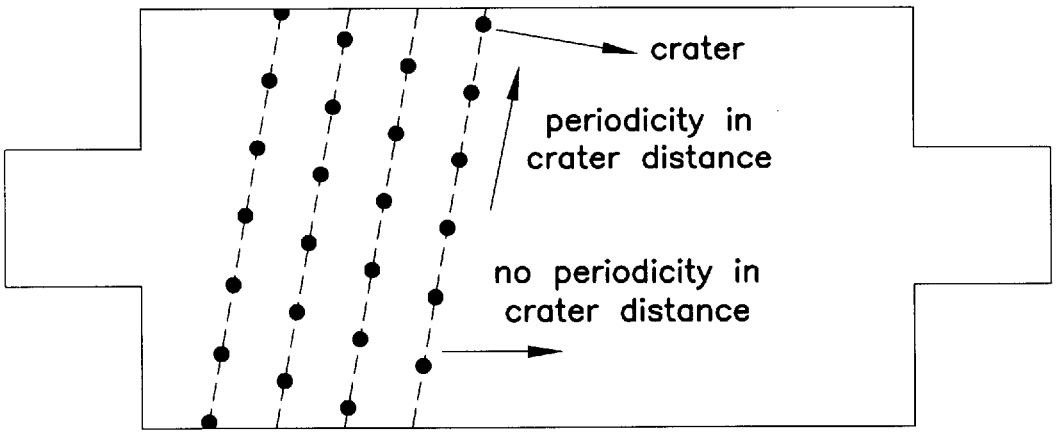
FIG. 3 represents the periodicity of laser and typical deterministic EBT texture wherein the unit cell is a centered regular hexagon.
Figure 3B:
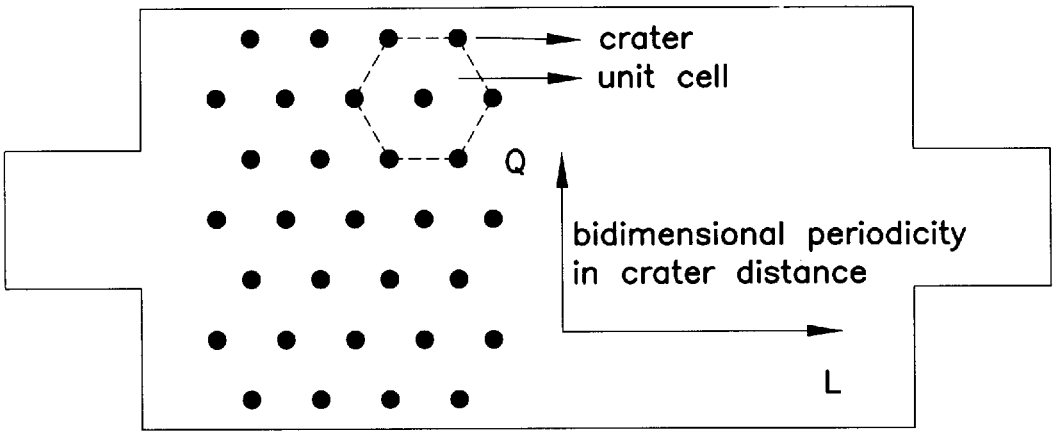

Although any pattern configuration can be produced (square, rectangle, etc.) and serves the purpose of the invention, normally use is made of a centered regular hexagon. Indeed, this configuration allows the maximum of craters on the minimum of surface (FIG. 3).

The choice of the combination of the parameters depends on the application of the cold rolled sheet. It is indeed possible to obtain the same Ra value for different sets of pattern parameters. However, once a set of parameters has been fixed, the created pattern is unique and entirely defined by it.

Figure 4:
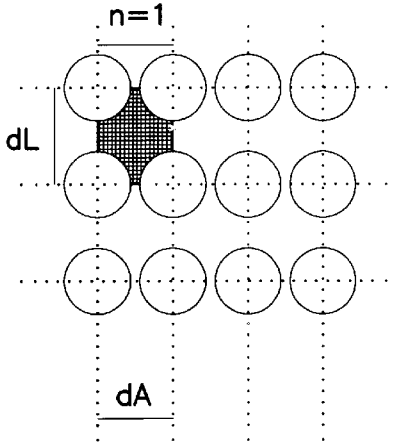
FIGS. 4, 5, & 6 represent EBT patterns (unit cell)which could be used in order to avoid moiré effect according to the present invention.
Figure 5:
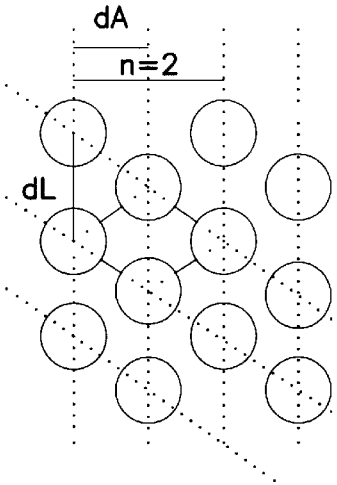
Figure 6:
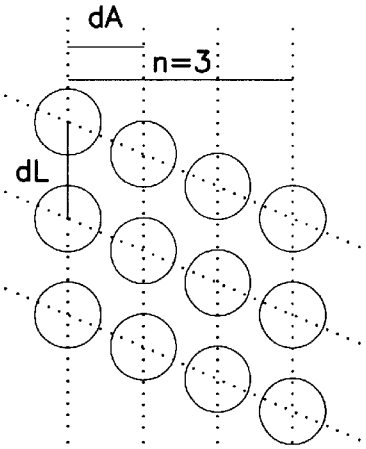

FIG. 4, 5 and 6 represent the parameters used in the patterns (regular unit cell) wherein;

dl=the distance between two craters in the circumferential direction of the roll which is the (longitudinal) rolling direction of the sheet of strip.

dq=the distance between two circumferential lines of craters in the axial direction of the roll which is transverse to the rolling direction of the sheet of strip=n.dA Sc=The raster distance between two craters for a regular hexagon.

According to this parametrization of the patterns, two interference models are possible:

1°) one with interference lines in the rolling direction and for which the longitudinal interference wavelength $\gamma_L$ is defined by the distance dq as follows:

$$dq=max\ (n^A dA^A,\ n^B dA^B) \tag{1}$$

$$dq_2=min\ (n^A dA^A, n^B dA^B) \tag{2}$$

$$\lambda_L = \frac{dq_1 dq_2}{m|kdq_2 - dq_1|} \tag{3}$$

2°) one with interference lines crosswise to the rolling direction and for which the transverse interference wavelength $\gamma_Q$ is defined by the distance dl as follows:

$$dl_1=max\ [dl^A,\ dl^B] \tag{4}$$

$$dl_2=min\ [dl^A,\ dl^B] \tag{5}$$

$$\lambda_Q = \frac{dl_1 dl_2}{m|ldl_2 - dl_1|} \tag{6}$$

wherein k,l are an entire number so that each denominator for $\gamma_L$ and $\gamma_Q$ is minimum, and m=min [nA, nB]

Example 1: Combination of two regular hexagons

Figure 7:
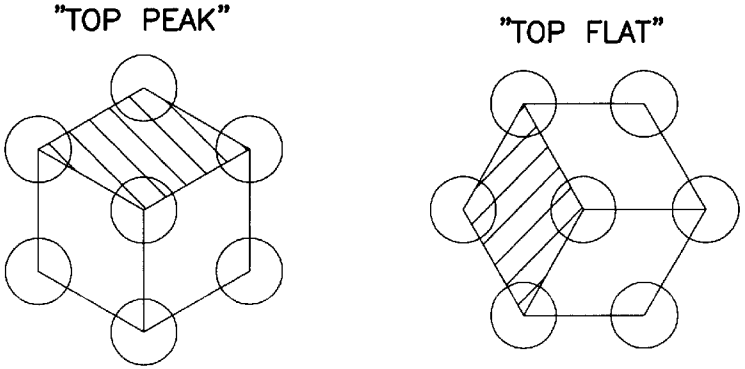
FIG. 7 represents EBT hexagonal patterns.

In FIG. 7, two centered regular hexagonal patterns are represented, once the hexagonal pattern is "top flat" and once the hexagonal pattern is "top peak".

Both patterns can be considered as rhombic patterns (dash parts) and accordingly m=2 in the above-mentioned formulas (3) and (6).

In the case of regular hexagonal patterns, we have for the "top flat" hexagonal pattern $$\frac{dl}{dq} = \sqrt{3}$$

and for a "top peak" hexagonal pattern $$\frac{dl}{dq} = \frac{1}{\sqrt{3}}$$

Figure 8:
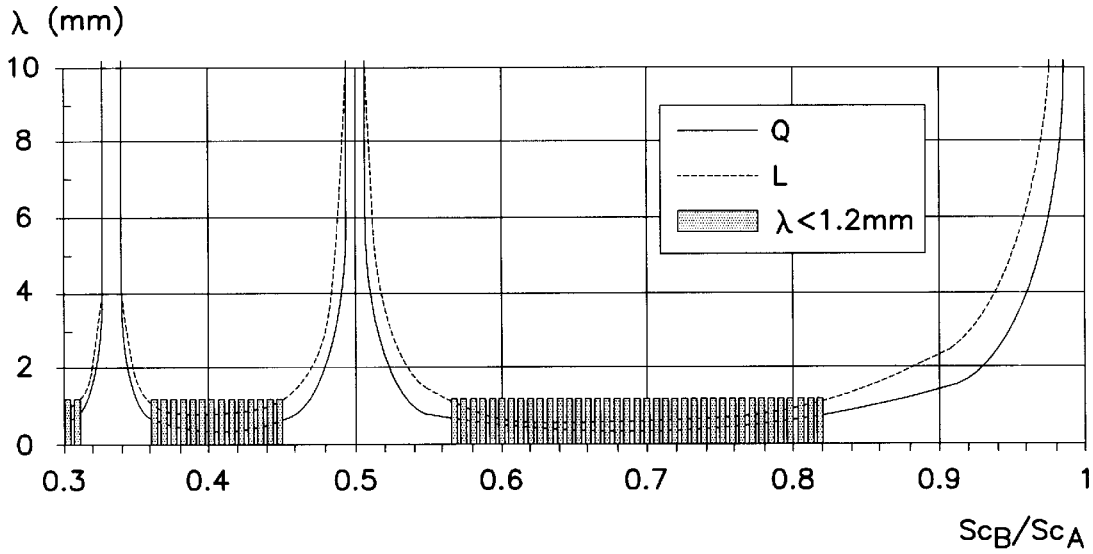
FIGS. 8 to 15 represent the moiré lines for several combinations of patterns wherein the wavelengths in the longitudinal and the transverse directions are represented in function of the ratio of the-raster distance between two craters for each roll ($Sc_B/Sc_A$).

FIG. 8 gives the Q and L interference lines for a combination of rolls wherein one of the rolls (A) has a hexagon "top peak" structure and the other (B) has hexagon "top flat" structure.

Figure 9:
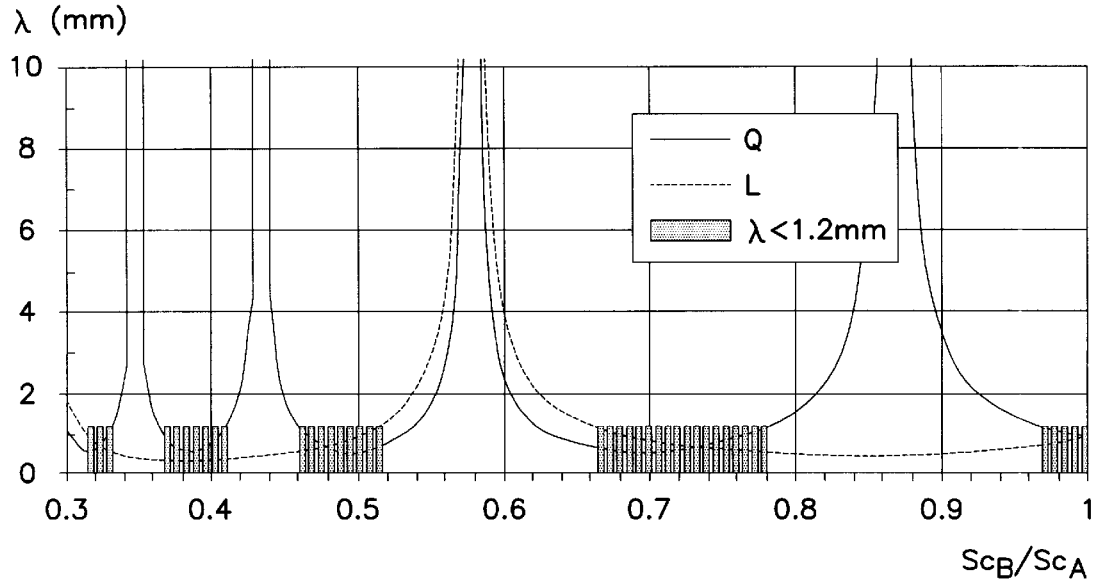

FIG. 9 gives the Q and L interference lines for a combination of rolls (A & B) wherein both rolls are "top peak" or "top flat".

In both FIGS. 8 & 9, the crater distance of the first roll (Scb) of 300 pm is always taken.

It is known from the trials that interference lines with a period higher than 1.5 mm are disturbing. Because of the uncertainty in carrying out the crater distances (due to the reduction of the tandem roll pattern in the skinpass), combinations with an interference period—longitudinal and transverse—lower than 1.2 mm are taken as a criterium for the useful working field. That useful working field is illustrated in FIGS. 8 and 9 with a dashed bloc.

On basis of the FIGS. 8 and 9, it can be decided that by using regular hexagonal patterns for a crater distance on the tandem rolls of 300 $\mu$m (target 298 $\mu$m; after lengthening on the skinpass 300 $\mu$m), the following crater distances on skinpass and pattern types can be used:

| | $Sc_B$ (tandem) = 300 $\mu$m | |
|---|---|---|
| $Sc_A$ (Skinpass) | Top peak + Top flat or Top flat + Top peak | Top peak + Top peak or Top flat + Top flat |
| 90 to 93 $\mu$m | — | OK |
| 93 to 108 $\mu$m | — | — |
| 108 to 111 $\mu$m | — | OK |
| 111 to 123 $\mu$m | OK | OK |
| 123 to 135 $\mu$m | — | OK |
| 135 to 138 $\mu$m | — | — |
| 138 to 156 $\mu$m | OK | — |
| 156 to 168 $\mu$m | — | — |
| 168 to 198 $\mu$m | — | OK |
| 198 to 234 $\mu$m | OK | OK |
| 234 to 246 $\mu$m | — | OK |
| 246 to 291 $\mu$m | — | — |
| 291 to 30 $\mu$m | OK | — |

The most interesting working fields for a tandem roll distance of 300 $\mu$m are skinpass gaps between 111 and 123 $\mu$m and between 198 and 234 $\mu$m. In that case, the combination of "top peak"+"top flat" as well as the combination "top peak"+"top peak" or "top flat"+"top flat" give no disturbing interference and the setting up of the patterns on the rolls play no role.

As during the rolling process reductions of 3 to 10% occur in the last stand of the tandem mill, where the texturing is applied, the possibility existed that the imprinted patterns on the metal sheet would be elongated, due to the sheet reduction. If this would have been the case, the pattern on the tandem roll should have to be adapted to the tandem mill reduction in order to obtain a regular hexagon after rolling. In practice this is not feasible because various tandem reductions appear in a given rolling schedule. Fortunately it just so happened that the patterns imprinted on the sheet matched exactly the roll patterns.

This can be explained "post factum", because of the fact that the imprint of the roll pattern on the metal sheet occurs where the pressure is the highest in the roll gap (the neutral point), after most of the reduction has taken place.

Per analogy, it is obvious that in the temper mill, where the reductions are much smaller (0.4 to 1.5% usually), the elongation problem of the roll pattern on the metal sheet does not occur.

The moiré effect would also be avoided if the wavelengths in the longitudinal direction and in the transverse direction are more than 25 mm.

For the combination of "top peak"+"top flat", infinitely wide interference bands are produced with the following ratios of crater distances $$\frac{\sqrt{3}}{2}, \frac{\sqrt{3}}{3}, \frac{\sqrt{3}}{4};$$

and for the combination "top peak"+"top peak" or "top flat"+"top flat", the infinitely wide interferences lie at the ratios ½, ½, ⅓, . . .

However, those points with infinitely wide interference do not form any useful working field due to the spreading at the tandem roll distance through the lengthening of the sheet in the skinpass. If a tandem roll distance of 300 $\mu$m with a skinpass gap of 260 $\mu$m is taken as an example, the ratio and the interference are as follows:

| $Sc_B$ (tandem) | $Sc_A$ (skinpass) | $Sc_B/Sc_A$ | Interference |
|---|---|---|---|
| 300 | 260 | 0.867 | 175 mm |
| 301 | 260 | 0.864 | 58 mm |
| 302 | 260 | 0.861 | 22 mm |
| 303 | 260 | 0.858 | 14 mm |

These working conditions are not stable and cannot be used for the following reasons:

Due to the reduction in the temper mill, the pattern flat was produced on the sheet will be elongated (with 0.4 to 1.5%, depending on the temper mill reduction that is used).

This means that the $SC_B/SC_A$ ratio will vary with the temper mill reduction. As the peaks in FIG. 8 & 9, where the moiré period is larger than 25 mm., are very small, the small variations in temper mill condition are sufficient for large variations in the moiré period.

The working points where the moiré pattern with a wavelength so large that it becomes invisible to the eye, are not stable enough to be used in practice.

In a similar way the working field can be adapted for other tandem roll distances and also for irregular hexagonal patterns.

Example 2: Combination of two non-regular hexagonal patterns

In this case, one can have $$\frac{dl}{dq} = 0{,}666$$

for "top flat" hexagonel pattern;

$$\frac{dl}{dq} = \frac{1}{0{,}666}$$

for "top peak" hexagonal pattern and m=2

Sc is the value of the smallest diagonal.

Figure 10:
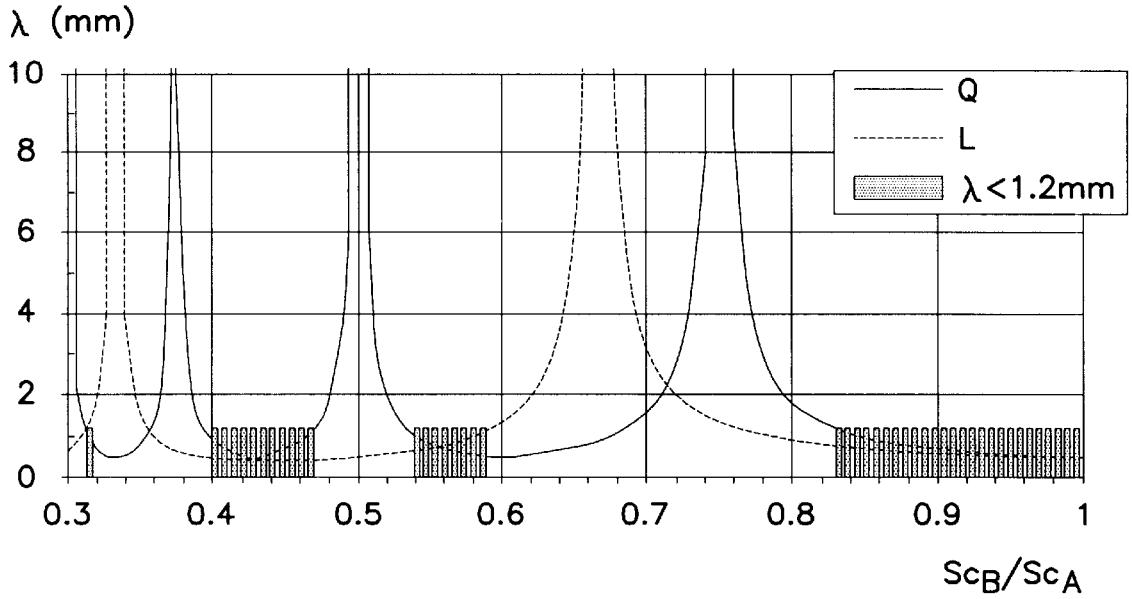
Figure 11:
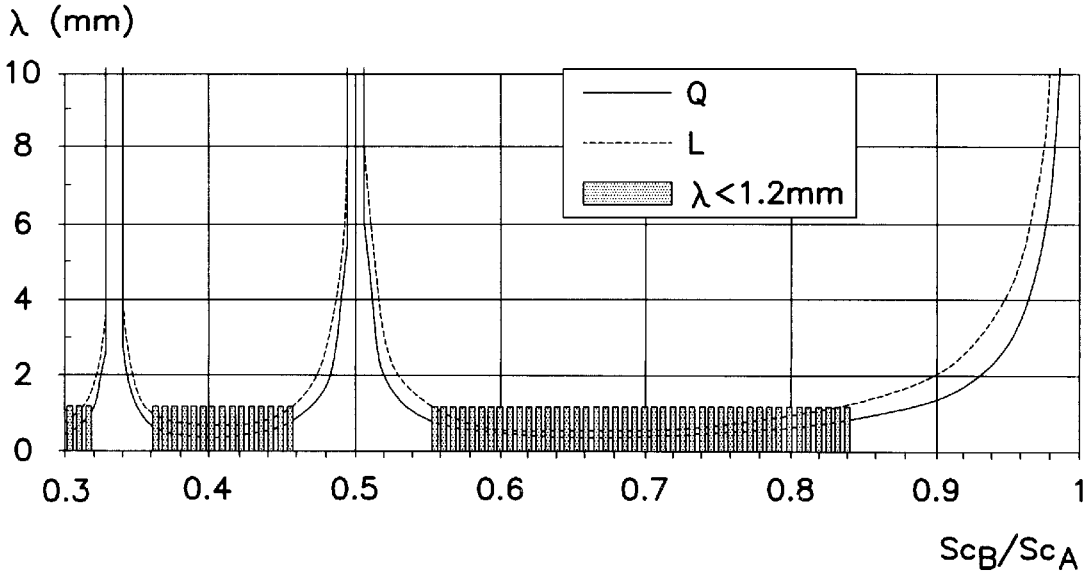

FIG. 10 and 11 give the Q and L interference lines for a combination of rolls wherein one of the rolls (A) has a non-regular "top peak" structure and the other roll (B) has a non-regular hexagon "top flat" structure and wherein both rolls are "top peak" or "top flat", respectively.

In both FIGS. 10 & 11, the crater distance $Sc_B$=300 $\mu$m.

From these figures, one can observe that a large field around the ratio of 1.00 is useable in the combination "top peak"+"top flat". In the combination "top peak"+"top peak" or "top flat"+"top flat", there are two important working fields from 0.36 to 0.46 and 0.55 to 0.82. The combination of both possibilities allows for every ratio between 0.36 and 1.00, except in the zone between 0.47 and 0.54.

Example 3: Combination of hexagonal and square patterns.

The square pattern with the diagonals in the roll direction and in the cross direction is a rhomb-shaped pattern having as characteristic parameters $dl=dq=\sqrt{2}Sc$ and m=2. This pattern is called square peak.

Figure 12:
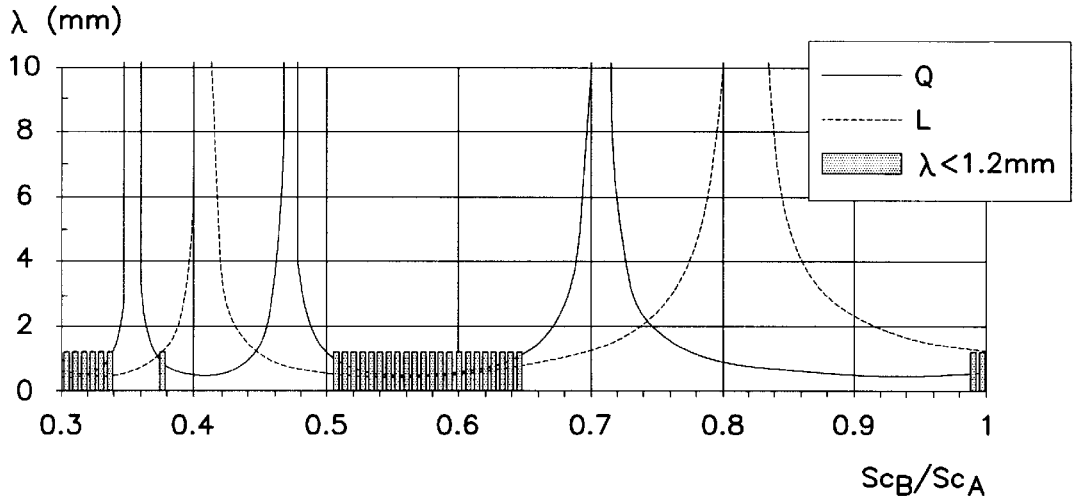
Figure 13:
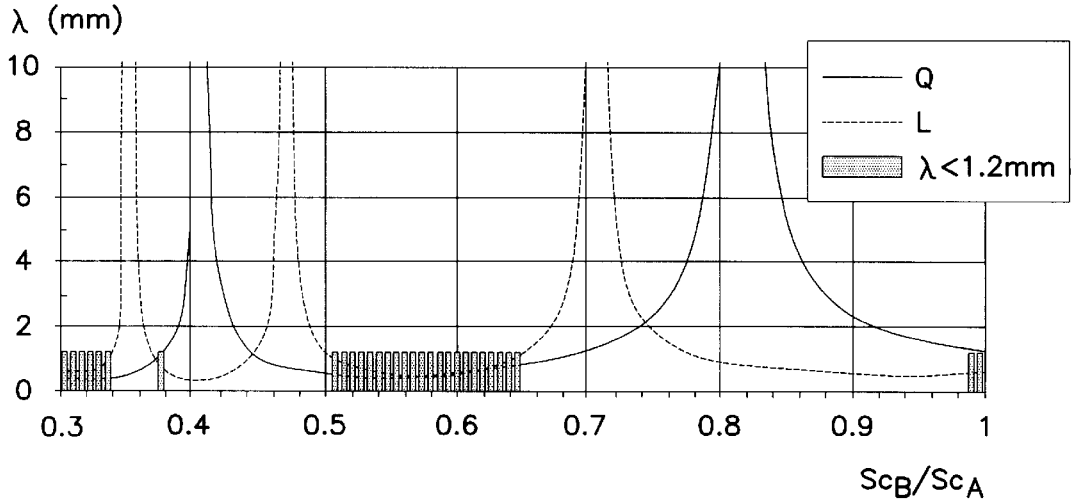

In combining an hexagonal pattern and a square pattern, two possibilities exist:

1°) The pattern with the smallest crater distance is of the hexagonal type and the pattern with the biggest crater distance is of the Square Peak type (with $SC_B$=300 gm in FIGS. 12 & 13).

Figure 14:
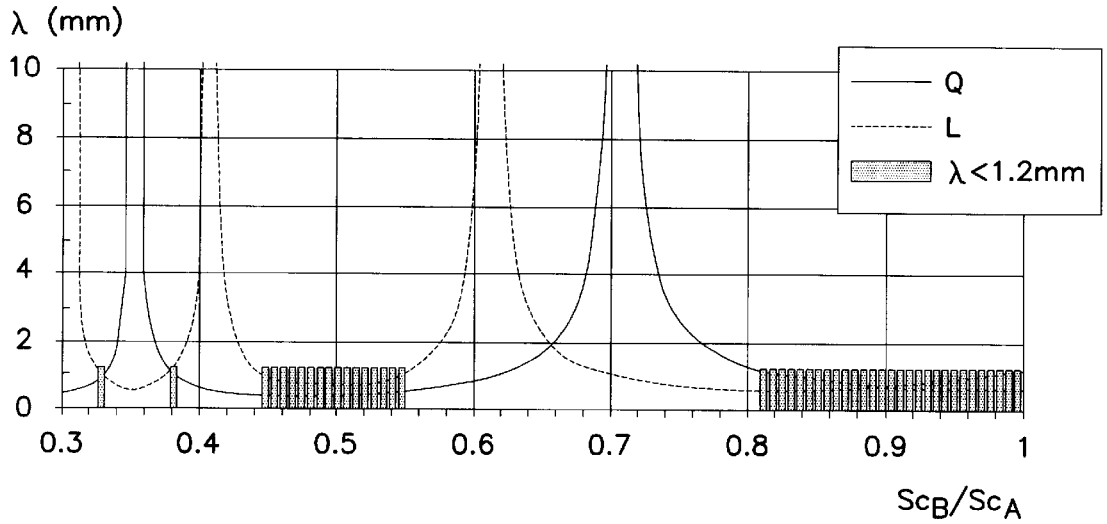
Figure 15:
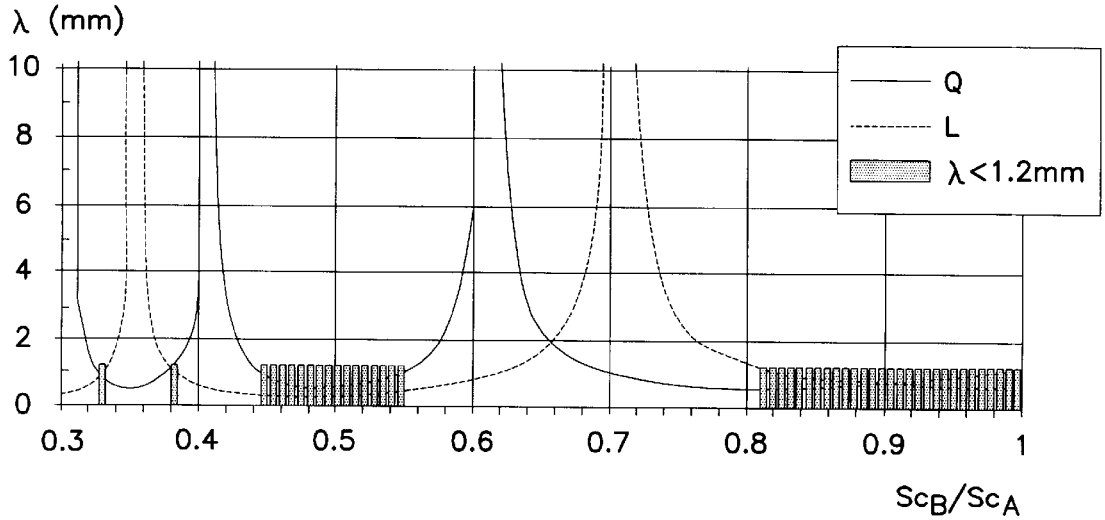

2°) The pattern with the smallest crater distance is of the Square Peak type and the pattern with the biggest crater distance is of the hexagonal type (with $Sc_A$=300 $\mu$m in FIGS. 14 & 15).

1°. The crater distance of the hexagonal pattern ($Sc_B$) is smaller than the square peak one ($Sc_A$).

The interference lines are given in FIGS. 11 and 12. The combination hexagon top peak/square top peak as well as the combination hexagon top peak/square peak produce the same interferences; only the transverse and longitudinal directions are changed.

There are more peaks with an infinite wide interference wavelengths than for combinations with only hexagonal patterns, namely according to the ratio of crater distances $$\frac{Sc_b}{Sc_A}=\frac{\sqrt{3}}{\sqrt{2}},\frac{\sqrt{2}}{2},\frac{\sqrt{2}}{3},\frac{\sqrt{3}}{2\sqrt{2}},\ldots$$

The zones with wavelengths smaller than 1.2 mm are limited to the ratio in crater distance from 0.30 to 0.34, from 0.53 to 0.65, from 0.99 to 1.00. That combination is less interesting than the combination hexagonal top peak and/or hexagonal top flat.

2°. The crater distance of the square peak ($Sc_B$) raster is smaller than the hexagonal one ($Sc_A$).

The interference lines for a combination of a square peak pattern with an hexagonal pattern with a bigger crater distance are given in FIGS. 14 and 15.

Again the patterns for the combination square peak/hexagon top peak with square peak/hexagon top flat are the same except for the interference direction. Theoretically, two interesting working fields are found: for a ratio in crater distances from 0.45 to 0.55 and from 0.81 to 1.00.

Example 4: Avoiding anti-moiré between lower and upper rolls in the same stand

Usually, in this case there is an extra restriction: the roughness of both rolls in the same stand must be the same. This means that $dl_A.dq_A=dl_B.dq_B$ There is a general theory according to which if one pattern ($dl_A$, $dq_A$) for the first roll is given, there exists another pattern ($dl_B$, $dq_B$) with the same roughening and a minimum interference periodicity. This second pattern is named the bias of the first pattern.

The parameters of the optimum bias pattern or diamond like pattern (t.i. with m=2) are found as follows:

If $dl_A$, $dq_A$ are given for a pattern of the roll (A)

$$dq_A=\frac{1}{\alpha}\,dl_A$$

then the minimal moiré periodicity is given by $$\frac{Sc_A}{Sc_B}=dq_B=\frac{2}{3\alpha}\,dl_A$$

and if $dl_A.dq_A=dl_B.dq_B$ $$\begin{cases} dl_B=\frac{3}{2}\,dl_A \\ dq_B=\frac{2}{3}\,dq_A \end{cases}$$

The pattern ratio $dq_B/dl_B$ of the bias pattern depending upon the original pattern $dl_A/dq_A$ is illustrated in FIG. 15.

Figure 16:
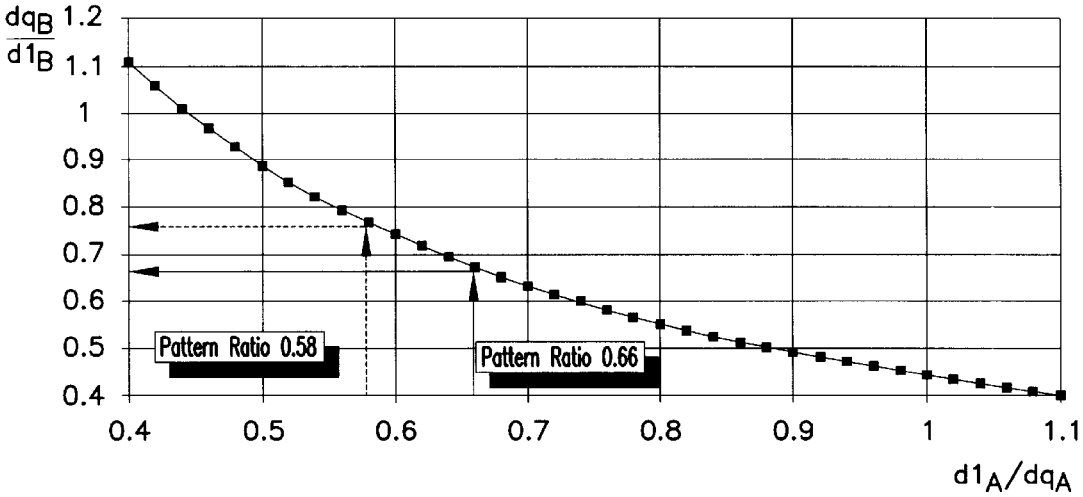
FIG. 16 represents the corolation of the parameters ($dl_A$, $dq_A$) of the first roll with the parameters ($dl_B$, $dq_B$) of the second roll for the same stand of rolls and having the same roughness.

It is quite clear on FIG. 16 that the pattern with a ratio $dl_A/dq_A$=0.66 is a special pattern.

For a pattern ratio of 0.66, the ratio of the bias pattern (=same roughening and minimum moiré interference) is again 0.66. That means that the same pattern can be placed on the lower and upper rolls through changing the orientation and that this combination results in a minimal moiré periodicity.

Figure 17:
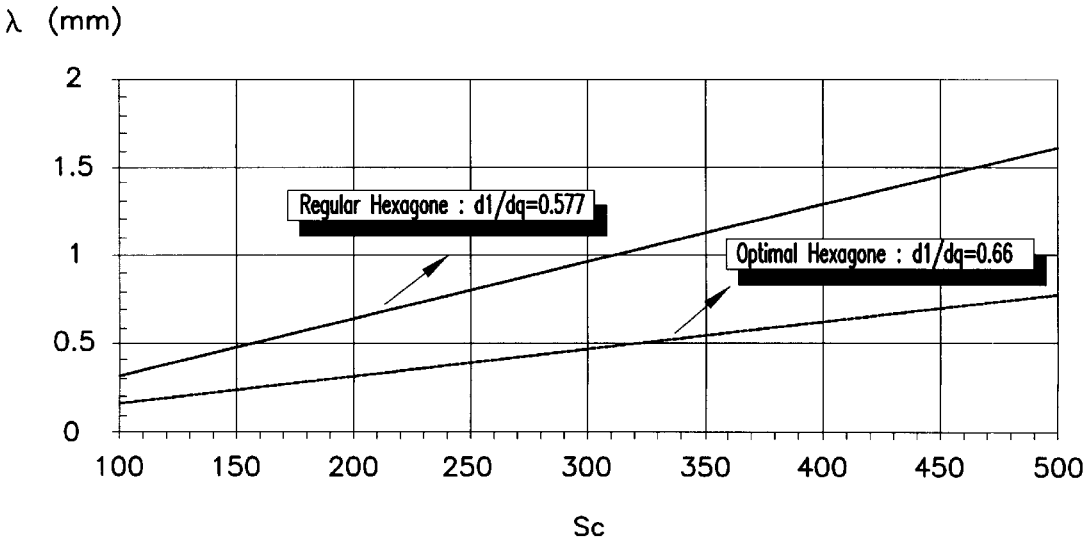
FIG. 17 represents the moiré lines between the upper and under rolls of the same stand having a regular hexagonal pattern or optimal hexagonal patterns.

In FIG. 17, the moiré wavelength that is formed between the lower and upper rolls is given according to the smallest diagonal (Sc) for regular hexagonal patterns "top peak"+"top flat" (wherein $$\frac{dl_A}{dq_A}=\sqrt{3}$$

and $$\frac{dl_B}{dq_B}=\frac{1}{\sqrt{3}}$$

and for the optimum pattern "top peak"+"top flat" wherein $$\frac{dl_A}{dq_A}=\frac{8}{3}$$

and $$\frac{dl_B}{dq_B}=\frac{3}{2}$$

The moiré interference is for the optimum pattern only 46% of the moiré interference of the regular hexagon. The maximum width of 1.2 mm without any disturbance of the margins is reached in the optimum pattern at 800 $\mu$m crater distance and in the regular hexagonal pattern at 370 $\mu$m.

Figure 18:
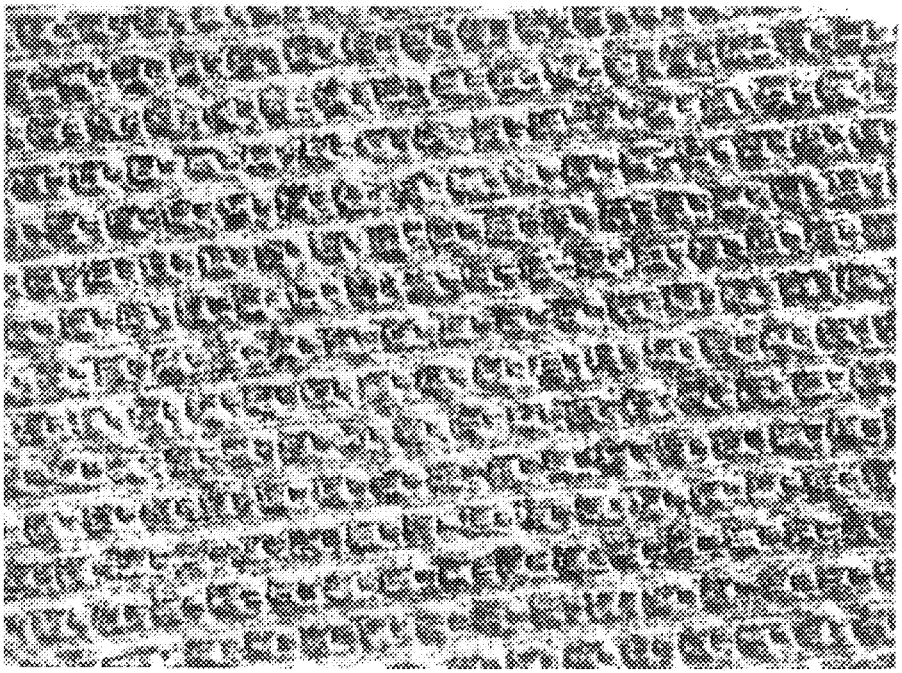
FIGS. 18 & 19 represent two examples of the moiré and anti moiré textured sheet (Sox).
Figure 19:
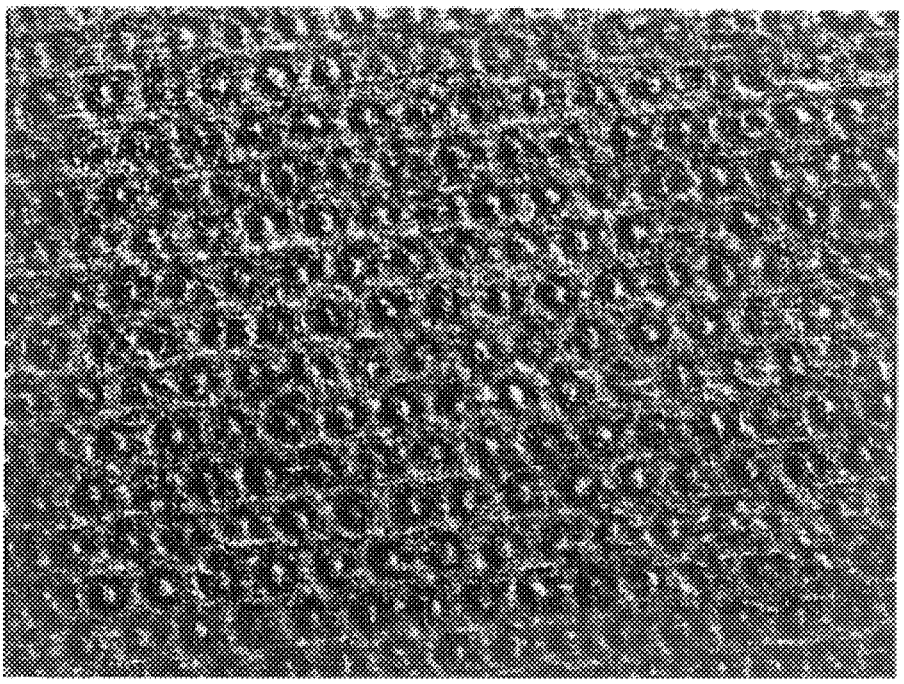

An example for the confirmation of the theory claimed in the present invention is given in FIG. 18 & 19 wherein two pair of rolls are textured, in one pair both rolls being "top flat" and the other pair, one roll being "top flat" and one roll being "top peak".

The mill was levelled and during this operation the moiré pattern appeared on the first pair (FIG. 18), whereas no moiré could be detected on the second pair (FIG. 19).

We claim:

1. Method of producing metal sheets or strips by rolling a metal sheet or strip through cold rolling mills, characterized in that at least two work rolls are textured according to a surface pattern consisting in a regular deterministic bidimensional pattern in the form of unit cells of spots, said spot being obtained through an electron beam irradiation and in that interference wavelengths in a longitudinal direction of the pattern on the rolls and in the transverse direction of the rolls are less than 1.5 mm wherein $\gamma_L$ and $\gamma_Q$ are defined as follows:

$$\lambda_L = \frac{dq_1 dq_2}{m|kdq_2 - dq_1|}$$

$$\lambda_Q = \frac{dl_1 dl_2}{m|ldl_2 - dl_1|}$$

wherein $dl_1$=max [$dl^A$, $dl^B$]

$dl_2$=min [$dl^A$, $dl^B$]

$dq_1$=max [$n^A dq^A$, $n^B dq^B$]

$dq_2$=min [$n^A dq^A$, $n^B dq^B$]

k,l=an integer so that the denominator is minimum m=min [$n^A$, $n^B$]

dl=the distance between two spots in the circumferential direction of the roll dq=the distance between two spots in the axial direction of the roll=n.dA dA=distance between two circumferences in the axial direction n=number of windings on the roll before the crater has the same circumferential position on the roll, n is an integer or a real number Superscript A=regarding the first textured work roll Superscript B=regarding the second textured work roll.

2. Method of producing metal sheets or strips according to claim 1 characterized in that both textured work rolls are consisting in a pair of work rolls in any stand of a tandem mill.

3. Method of producing metal sheets or strips according to claim 1 characterized in that both textured work rolls are consisting in a pair of work rolls in any stand of a temper mill.

4. Method of producing metal sheets or strips according to claim 1 characterized in that the textured work rolls are once used as the upper work roll and/or the lower work roll in any stand of the tandem mill and once used as the upper and/or the lower work roll in any stand of the temper mill.

5. Method of producing metal sheets or strips according to claim 1 characterized in that the unit cell is a centered regular hexagon or a square.

6. Method of producing metal sheets or strips according to claim 5 characterized in that the unit cell could be "top peak" or "top flat".

7. Device for producing metal sheets or strips by cold rolling a metal sheet or strip characterized in that it comprises at least two work rolls which are textured according to a surface pattern consisting in a regular deterministic bidimensional pattern in the form of unit cells of spots, said spots being obtained through an electron beam irradiation and in that interference wavelengths in a longitudinal direction of the pattern on the rolls and In the transverse direction of the roll are less than 1.5 mm.

8. Device according to claim 7 characterized in that said textured work rolls are consulting in a pair of work rolls in any stand of a tandem mill.

9. Device according to claim 7 characterized in that both textured work rolls are consisting in a pair or work rolls in any stand of a temper mill.

10. Device according to claim 7 characterized in that the textured work rolls are once used as the upper work roll and/or the lower work roll in a stand of a tandem mill and once used as the upper work roll and/or the lower work roll in a stand of a temper mill.

* * * * *